US007887272B2

(12) United States Patent
Bohman et al.

(10) Patent No.: US 7,887,272 B2
(45) Date of Patent: Feb. 15, 2011

(54) LOAD SECURITY DEVICE INCLUDING A COUPLING PART WITH SNAP ACTION

(75) Inventors: Hans Bohman, Stockholm (SE); David Hsieh, Taichung (TW)

(73) Assignee: Cargotec Finland Oy, Tampere (FI)

( * ) Notice: Subject to any disclaimer, the term of this patent is extended or adjusted under 35 U.S.C. 154(b) by 717 days.

(21) Appl. No.: 11/665,218

(22) PCT Filed: Oct. 28, 2005
(Under 37 CFR 1.47)

(86) PCT No.: PCT/SE2005/001618

§ 371 (c)(1),
(2), (4) Date: Dec. 21, 2007

(87) PCT Pub. No.: WO2006/046921

PCT Pub. Date: May 4, 2006

(65) Prior Publication Data

US 2008/0213060 A1 Sep. 4, 2008

(30) Foreign Application Priority Data

Oct. 28, 2004 (SE) ..... 0402626
Mar. 3, 2005 (SE) ..... 0500484

(51) Int. Cl.
*B60P 7/13* (2006.01)
*B63B 25/24* (2006.01)

(52) U.S. Cl. ..... 410/100

(58) Field of Classification Search ..... 410/77, 410/84, 85, 96, 100, 101, 102, 106; 24/298, 24/68 CD, 265 CD
See application file for complete search history.

(56) References Cited

U.S. PATENT DOCUMENTS 1,005,301 A * 10/1911 Pipher ..... 403/166

(Continued)

FOREIGN PATENT DOCUMENTS

EP 100 56 341 7/2002

(Continued)

OTHER PUBLICATIONS

Taiwanese Search Report dated Nov. 6, 2008 for corresponding Taiwanese application No. 094137993.

(Continued)

*Primary Examiner*—H Gutman
(74) *Attorney, Agent, or Firm*—Harness, Dickey & Pierce, P.L.C.

(57) ABSTRACT

A lashing device includes a stretching device which is to be fastened between two fixing points that are to be secured to one another, the stretching device including stretching device parts which are each connectible to one of the fixing points. At least a first stretching device part has a stretching rod extending in the longitudinal direction of the stretching device and has a threaded portion. A second stretching device part supports a nut part which is to be screwed onto the thread of the first stretching device part. Between the first and the second stretching device part, a coupling part is arranged which, by snap action, allows mutual rotation of the two stretching device parts in at least a direction of rotation which corresponds to tightening of the stretching device and counteracts rotation in the opposite direction.

20 Claims, 7 Drawing Sheets

U.S. PATENT DOCUMENTS

| | | | | |
|---|---|---|---|---|
| 1,974,686 | A * | 9/1934 | Meyercord | 410/84 |
| 3,719,377 | A * | 3/1973 | Schultz et al. | 403/44 |
| 3,877,672 | A | 4/1975 | Wright | |
| 5,143,010 | A * | 9/1992 | Behr et al. | 114/75 |
| 6,065,914 | A * | 5/2000 | Fotou | 410/3 |
| 6,161,981 | A | 12/2000 | Dehlin | |
| 6,666,633 | B2 * | 12/2003 | Hsieh | 410/85 |
| 6,666,634 | B1 | 12/2003 | Hsieh | |
| 6,758,643 | B1 | 7/2004 | Hsieh | |
| 7,014,399 | B1 * | 3/2006 | Hsieh | 410/85 |
| 7,399,148 | B2 * | 7/2008 | Bruun | 410/85 |
| 7,422,400 | B2 * | 9/2008 | Hsieh | 410/85 |
| 2003/0215299 | A1 | 11/2003 | Hsieh | |

FOREIGN PATENT DOCUMENTS

| | | |
|---|---|---|
| TW | 348142 | 12/1998 |
| TW | 592198 | 6/2004 |
| TW | 1236447 | 7/2005 |
| WO | WO 03/072427 | 9/2003 |

OTHER PUBLICATIONS

International Search Report (PCT/ISA/210), Dated Feb. 1, 2006.
European Office Action from corresponding European application, Dated May 15, 2009.

* cited by examiner

LOAD SECURITY DEVICE INCLUDING A COUPLING PART WITH SNAP ACTION

FIELD OF THE INVENTION

The present invention relates to a load security device or lashing device consisting of a stretching means which is to be fastened between two fixing points that are to be secured to one another and which consists of stretching means parts which are each connectible to one of the fixing points and of which at least a first stretching means part has a stretching rod extending in the longitudinal direction of the stretching means and having a threaded portion and a second stretching means part supports a nut part which is to be screwed onto the thread of the first stretching means part.

BACKGROUND ART

When transporting goods, for example, on cargo ships, trains and trucks, the goods are stored in containers for instance. The containers are often stacked on top of each other to allow a great cargo capacity to be transported simultaneously. Stacking of containers also occurs in storing of goods. Containers of this type, which are often referred to as ISO containers, allow the transported goods to be well protected during transport and also in loading and unloading.

Containers of the type described above are usually rectangular with floor, roof, two side walls and two end walls. At the corners of the containers, corner fittings are usually arranged, which are used to connect and lash containers. To connect and lash containers, lockable couplings are used as a rule, which can be inserted into and locked to a corner fitting of a container.

Lashing devices for lashing are frequently designed as stretching screws where the upper end of the stretching screw is fixed to a corner fitting of a container and the lower end of the stretching screw is fixed to the deck of the ship or a loading platform. It is also common for the upper end of the stretching screw to be fixed to a corner fitting of an upper container and the lower end of the stretching screw to be fixed to a corner fitting of a container which is positioned at one or more levels below the upper container.

In order to lash containers, the lashing system is tightened (stretched) by the stretching screw being tightened by rotation. After tightening of the lashing device, the stretching screw is usually locked by a check nut. It frequently happens that such check nuts can be released due to vibrations or the like during transport. If a check nut is released, there is a risk that the stretching screw is released, thus impairing the lashing or even making it cease. The operation of tightening a released check nut during transport may involve serious danger to an operator who is to perform this operation.

U.S. Pat. No. 6,666,634 discloses another lashing device where the stretching screw is secured after tightening by a locking seat with a non-cylindrical hole being moved into form-fit engagement with an end of the stretching screw. Locking of the described lashing device means that the end of the stretching screw is oriented in a certain position which conforms with the geometry of the seat to allow the two parts to be moved into engagement with one another.

Lashing often is a time-consuming operation which requires that the lashing device be simple and effective to handle. There is also a risk that the locking of the stretching screw is not ensured because this operation has not been correctly performed, which may cause serious consequences and involve great danger.

SUMMARY OF THE INVENTION

An object of the present invention thus is to provide a lashing device which allows safe and reliable anchoring of, for instance, containers.

The above objects and other objects that will be evident from the following description are achieved by a lashing device according to the appended claims.

According to one aspect of the invention, a lashing device is provided, consisting of a stretching means which is to be fastened between two fixing points that are to be secured to one another and which consists of stretching means parts which are each connectible to one of the fixing points and of which at least a first stretching means part has a stretching rod extending in the longitudinal direction of the stretching means and having a threaded portion and a second stretching means part supports a nut part which is to be screwed onto the thread of the first stretching means part, wherein there is arranged between said first and said second stretching means part a coupling part which by snap action allows mutual rotation of the two stretching means parts in at least a direction of rotation which corresponds to tightening of the stretching means and counteracts rotation in the opposite direction.

A lashing system is thus provided, which allows the coupling part to be arranged in cooperation with the two stretching means parts during at least tightening of the lashing system. At the same time the coupling part counteracts, after tightening, that the lashing device is released due to vibrations, load changes, seaway, impacts or the like that may arise during transport for instance. Such a lashing device can thus provide an easier and safer lashing operation by allowing the coupling part to be arranged in its active position even before and during tightening of the lashing device. Furthermore the coupling part counteracts release of a lashing system without any further operation after tightening of the lashing device. This reduces the risk that the coupling part is not correctly activated or not activated at all owing to, for instance, an operator's lack of attention.

By tightening or stretching of the lashing device is meant that the distance between the ends of the stretching means is shortened by at least relative rotation between the first and the second stretching means part which are in threaded engagement with one another. Furthermore release of the lashing device means that the distance between the ends of the stretching means is increased by relative rotation between the first and the second stretching means part in a direction of rotation opposite to that of tightening.

A further advantage achieved by allowing the coupling part to be arranged or moved to its active position before tightening is that, for instance, skewness between the first and the second stretching means part can be handled more easily. When great loads act on the lashing device after tightening, such skewness between the stretching means parts can make it difficult to move a coupling part to its active position. However, when the coupling part can already be arranged or moved to its active position when the lashing system is essentially unloaded, such skewness can be overcome more easily. The skewness may consist of, for instance, the two stretching means parts deviating from parallelism with one another.

The term "snap action" relates to provision of cyclic torque variation when the stretching means parts are rotated relative to each other. The snap function of the coupling part is at least partly active during mutual rotation of the two stretching means parts in a direction of rotation that corresponds to tightening of the stretching means. The snap action can also be active for planned release of the lashing device by, for instance, a tool, where mutual rotation of the two stretching means parts occurs in a direction of rotation that corresponds to release of the stretching means. Moreover the coupling part arranged between the two mutually rotatable stretching means parts counteracts, in normal use for lashing, that the lashing system is unintentionally released in a direction of rotation which is opposite to the tightening direction of rotation.

In one embodiment of a lashing device, the coupling part can be provided with an engaging part which by said snap action cooperates with a gripping part, the engaging part and the gripping part being each separately associated with either the first or the second stretching means part. Consequently such an engaging part can be arranged on, or in connection with, either the first or the second stretching means part, and thus the gripping part is arranged on the stretching means part which does not have an engaging part.

By engaging part is meant at least a portion which is arranged to extend into a corresponding portion which is arranged to receive said engaging part. The portion which is intended to receive the engaging part thus constitutes the gripping part or a portion of the gripping part. The engaging part and the gripping part are arranged to be moved into abutment against one another at least periodically during mutual rotation of the stretching means parts. The engaging part and the gripping part suitably abut against each other essentially during the entire rotation.

In one embodiment of a lashing device, the engaging part is movably arranged in a direction away from said gripping part during mutual rotation of the two stretching means parts in at least the direction of rotation that corresponds to tightening of the stretching means. When the stretching means parts are rotated relative to each other in at least the tightening direction, abutment between the engaging part and the gripping part implies that the engaging part is moved away from the gripping part. In this manner, at least a portion of the engaging part is moved away from a path of travel relative to the gripping part, the engaging part and the engaging part during rotation being allowed to run relative to one another.

In one embodiment, said engaging part of the lashing device can be arranged as a locking means which by lock action locks against mutual rotation of the stretching means parts in the direction opposite to tightening of the stretching means. For this embodiment an action is provided, which locks in the releasing direction of rotation and counteracts that the lashing device is unintentionally released due to, for instance, vibrations, load changes, seaway, impacts or the like during transport. When releasing the lashing device, the engaging part and the gripping part can be moved apart to allow rotation in the releasing direction of rotation.

To obtain said locking function of the lashing device, an engaging portion of said engaging part can be arranged to be clamped between an abutment of said gripping part and an abutment of the engaging part during mutual rotation between the stretching means parts in the direction opposite to tightening of the stretching means. In this way the engaging portion constitutes an element locking against rotation between the abutments and counteracting that the two abutments of the gripping part and the engaging part, respectively, can pass one another in the releasing direction of rotation, thus ensuring locking against rotation. In one embodiment, the lashing device arranged with a locking function can at the same time be provided with a gripping part which is arranged to move the engaging portion of said engaging part away from said abutment of the engaging part in mutual rotation between the stretching means parts in said direction for tightening of the stretching means. Consequently such a design results in a coupling part which allows mutual rotation of the stretching means parts during rotation in the tightening direction of rotation and a locking function in the releasing direction of rotation. Such a design is advantageous since a coupling part can be arranged in the active position during tightening of the lashing device while at the same time a locking function for unintentional release of the lashing device during, for instance, transport is safely counteracted.

In one embodiment of a lashing device, an engaging portion of said engaging part can be spring loaded towards the gripping part. The spring-loaded engaging portion is pressed towards the gripping part for abutment against the same. Snap action during rotation can be obtained by the gripping part being provided with a portion which has an abutment surface deviating from the cylindrical shape and oriented towards the engaging part. When the engaging part and the gripping part rotate relative to one another, the engaging part is allowed, by movability and spring load, to yieldingly follow the gripping part surface deviating from the cylindrical shape in at least one direction of rotation. In one embodiment, the spring force and the shape of the gripping part and/or the engaging part can be arranged relative to each other in such a manner that a snap function with a desirable torque resistance is obtained in the respective directions of rotation. Alternatively, the shape of the engaging part and the gripping part can be arranged in such a manner that rotation under snap action is provided in the tightening direction of rotation and a locking action is provided in the releasing direction of rotation.

To allow the engaging part of the lashing device to be moved into engagement with the gripping part, an engaging portion of said engaging part is suitably under spring load at least partially projectable from a peripheral surface of an opening in the coupling part. By the engaging portion being at least partially projectable, the engaging portion is allowed to at least partially abut against the gripping part during mutual rotation of the stretching means parts. An engaging portion of the engaging part suitably projects to such an extent that a continuous abutment against the gripping part is provided. A continuous abutment against the gripping part can give a more uniform snap action and, thus, softer rotation of the lashing device. Furthermore continuous abutment force between the engaging part and the gripping part, for instance by spring action, may help to counteract that the engaging part and the gripping part are moved relative to each other in the longitudinal direction of the stretching means. This may be convenient to counteract that the engaging part and the gripping part are unintentionally moved apart during use owing to external stress, such as vibrations and the like.

Moreover an engaging portion of the engaging part of the lashing device can be arranged in at least one bore which extends in said coupling part. The bore can thus constitute a path of travel or guide for the movability of the engaging portion.

In at least one alternative embodiment of a lashing device, an end portion, positioned next to the gripping. part, of said bore may be designed to form an end position abutment for the engaging portion of the engaging part. By arranging the bore with an end position abutment, the length of the projecting part of the engaging portion through the mouth of the bore next to the gripping part can be limited. This can be advantageous to counteract that the entire engaging portion can pass through the mouth of the bore. Consequently the engaging portion can also be kept in place in relation to the engaging part when the engaging part and the gripping part are possibly moved apart.

In one embodiment of a lashing device, the engaging portion of the engaging part can be movable along a path of travel which extends in a direction spaced from the centre of said stretching rod. By arranging the extent of this path of travel, such as a bore, radially offset relative to the centre of the stretching rod, the engaging portion is allowed to abut against the gripping portion in such a manner that the engaging portion is forced against an abutment in mutual rotation between the stretching means parts in the releasing direction of rotation. Such an abutment suitably consists of an abutment arranged at one end of the bore, as described above.

When the engaging portion is forced against the end abutment in this way, the engaging portion may constitute a lock which counteracts continued rotation of the gripping part. Similarly to that described above, the engaging portion is allowed to be moved away from the gripping part along the radially offset path of travel in mutual rotation between the stretching means parts in the tightening direction of rotation.

In one embodiment, an engaging portion of the engaging part is suitably designed as a spring-loaded pin-like element. However, it will be appreciated by a person skilled in the art that this engaging portion can be designed in a number of alternative ways, such as spring-loaded balls, resilient metal sheets, elements of an elastic material etc. It will also be appreciated that the shape of these engaging portions can be varied in several ways to provide different types of abutment surface against the gripping part, in which case the resistance to rotation of the snap function can be affected.

The gripping part can be formed as grooves or recesses arranged in the coupling part and having different geometries. In one embodiment, the gripping part is arranged as an undulated surface which extends along the periphery of the gripping part. In an alternative embodiment, the peripheral surface of the gripping part can be provided with portions or lugs projecting from the surface. Such projecting portions can suitably be formed with a slightly inclined surface and a surface which is sharply inclined relative to the slightly inclined surface to provide a snap function in one direction of rotation of the lashing device and a locking or rotation-preventing function in the other direction of rotation.

In one embodiment, the gripping part is arranged as a portion of the stretching rod of the lashing device. For this embodiment, the engaging part is arranged on a part which is opposite to the gripping part and has an opening adapted to at least receive said stretching rod in the snap-acting position of the coupling device. This part of the coupling device is suitably arranged as a casing or the like which extends between the two stretching means parts.

It will thus be appreciated that the coupling part can consist of a portion of the stretching rod, or at least a part which is connected with the stretching rod, and at least a part which is connected with the stretching means part rotatable relative to the stretching rod.

The lashing device can be arranged so that at least part of the coupling part is movable relative to the stretching rod in the longitudinal direction of the stretching means. Such movability can be achieved by the stretching rod being formed with a gripping part which extends along an elongate portion in the longitudinal direction of the stretching means. The extent of the gripping part suitably exceeds the length of the difference in length of the stretching means between the released position and the tightened position. The part of the coupling part which is movable relative to the stretching rod can be fixed to the other stretching means part which has a nut part. In tightening, and optionally in release, of the lashing device, the engaging portion is allowed to slide relative to the gripping part in the longitudinal direction of the stretching means. In this manner the length of the stretching means can be adjusted in at least one direction with the coupling part arranged in a snap-acting position.

An alternative embodiment of a lashing device can be arranged with a coupling part which is movable relative to the stretching rod by the coupling part being allowed to be moved relative to the stretching means part rotatable to the stretching rod. Consequently said coupling part is movably arranged relative to said nut part in the longitudinal direction of the stretching means. The engaging part and the gripping part of the coupling part can by such a design be arranged to be moved apart from snap action. Suitably the coupling part is arranged to be moved between an active position and an inactive position, the coupling part in the active position being moved over a portion of said stretching rod to counteract or lock against mutual rotation between the stretching means parts in the direction opposite to tightening of the stretching means, while mutual rotation between the stretching means parts in the direction opposite to tightening of the stretching means is allowed when the coupling part is removed from said portion in the inactive position of the coupling part. The engaging part and the gripping part can also be moved apart, for instance, when exchanging some part of the coupling part or other parts of the lashing device. Preferably said portion of the stretching rod for cooperation between the engaging part and the gripping part consists of an end portion, located next to the coupling part, of the stretching rod. However, it is also possible to provide the stretching rod with two portions between which the coupling part can be moved. For example, the coupling part can be moved along the stretching rod between a first portion which constitutes an active position for snap action between the stretching means parts and a second portion which constitutes an inactive position where the stretching means parts rotate freely relative to one another. In the position where the snap action is provided, also a locking action can be provided in a direction of rotation opposite to the direction of rotation for snap action.

In some applications, when the coupling part is located in its active position for snap engagement between the engaging and the gripping part, it is convenient to be able to counteract axial movement of the coupling part in relation to the stretching rod. For example, this is advantageous when the lashing device is arranged so that its longitudinal direction extends substantially horizontally, referred to as horizontal lashing. In this case, for instance, gravity acting on the coupling part can be insufficient to allow adequate keeping in place of the coupling part relative to the longitudinal direction of the stretching rod. For the purpose of keeping the coupling part in place relative to the stretching rod, the coupling part can in one embodiment be provided with a locking element for locking engagement with said stretching rod and counteraction of movement of the coupling part in the longitudinal direction of the stretching means when connecting said stretching means parts to each other. Such a locking element can also be suitable to counteract that the coupling part is moved relative to the stretching rod, in the longitudinal direction of the stretching means, due to vibrations, load changes, seaway, impacts or the like.

In one embodiment, the locking element can be made of a resilient material. A locking element of resilient material can be suitable to facilitate moving together and moving apart of the engaging part relative to the gripping part. The coupling part is suitably designed to be moved into engagement with a threaded portion of said stretching rod. Preferably this threaded portion of the stretching rod is arranged in connection with, or in the vicinity of, the portion of the stretching rod that constitutes part of the coupling part.

In one embodiment, the locking element is arranged as a yoke, suitably of a resilient material, with a substantially part-circular portion to at least partly surround and engage said stretching rod. In an alternative embodiment, the locking element is formed as one or more hook means, suitably of a resilient material, which are arranged to engage the stretching rod. However, it will be appreciated by a person skilled in the art that the locking element can be designed in various ways. The locking element is suitably fixed to a portion of the coupling part which extends between the two stretching means parts.

BRIEF DESCRIPTION OF THE DRAWINGS

The invention will now be described in more detail with reference to the accompanying schematic drawings which by way of example illustrate preferred embodiments of the invention.

DESCRIPTION OF PREFERRED EMBODIMENTS

Figure 1A:
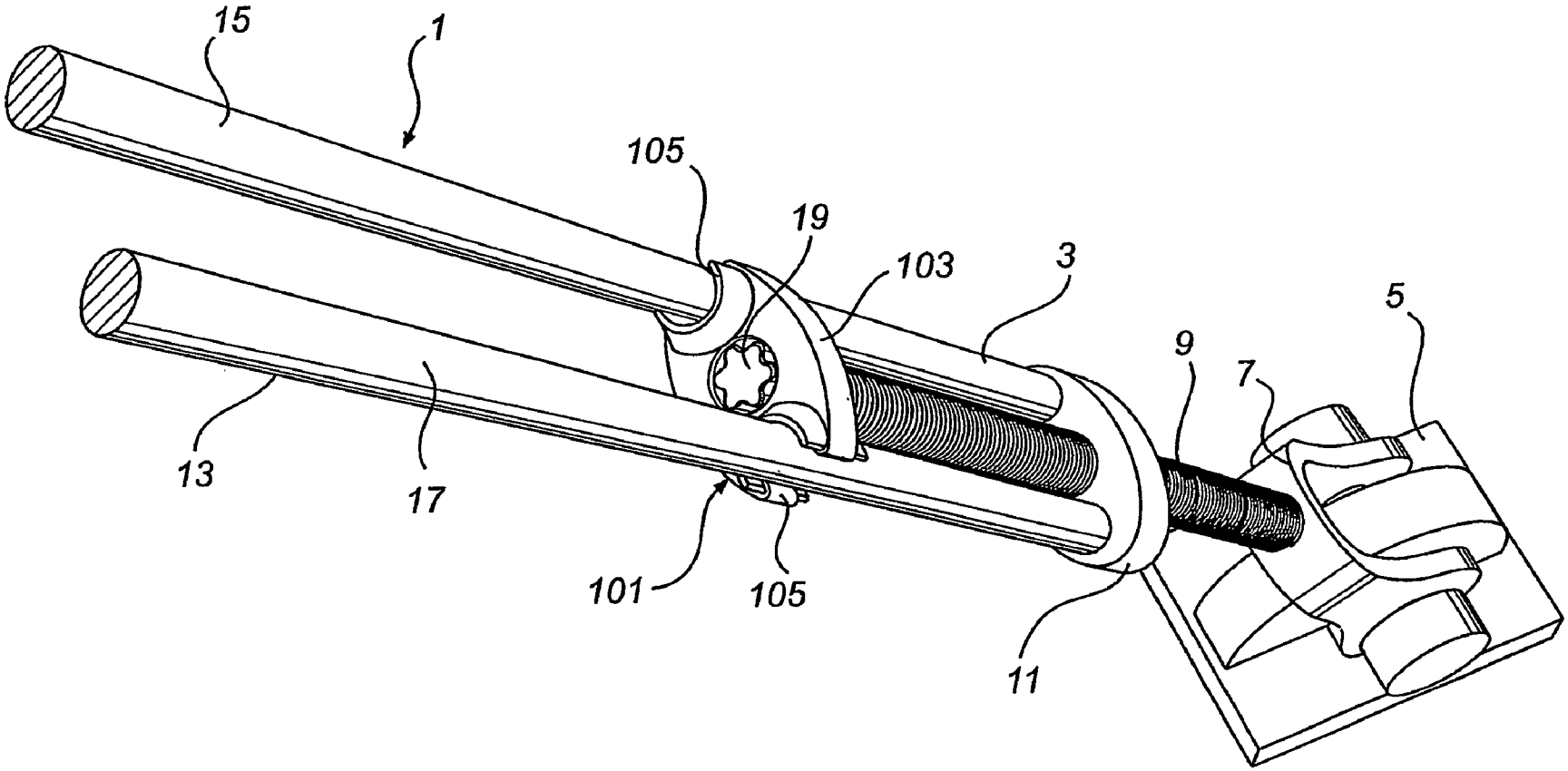
FIG. 1*a* is a schematic perspective view of part of a lashing device, comprising a coupling part in its active position.

FIG. 1*a* is a schematic perspective view of a lashing device 1 for lashing of, for instance, containers or the like. The lashing device 1 according to FIG. 1*a* has a stretching means 3 which is adapted to connect two attachments 5 (only one is shown). The stretching means 3 consists of a first stretching means part 7 which has a stretching rod 9 which is articulated to the attachment 5. The stretching rod 9 has a threaded portion which is in threaded engagement with a nut part 11 of a second stretching means part 13. The threaded stretching rod 9 and the nut part 11 allow the length of the stretching means 3 to be adjusted to allow tightening and release of the lashing device 1. Moreover the second stretching means part 13 comprises two substantially parallel rods 15, 17, the one ends of which are connected to the nut part 11.

At the other end of the lashing system 1 (not shown), a corresponding attachment can be arranged which is adapted to be connected to a container or the like. The second attachment can be connected to a stretching rod similar to that of the first stretching means part 7. In this case the stretching rod is in threaded engagement with a second nut part, which is arranged in connection with the ends of the rods 15, 17 which are opposite to the first nut part 11. Consequently the stretching means 3 is formed as a stretching screw.

It is also possible to arrange one end of the stretching means 3 rotatably connected to an attachment without a threaded stretching rod. Consequently the entire adjustment of the length of the stretching means 3 occurs at the end having a stretching rod 9.

The attachment 5 which is shown in FIG. 1*a* is connected to a loading platform or the like, but can also be arranged to be connected to a container. The attachment can be connected, for instance, to a corner fitting of a container. The corner fitting of a container is usually formed with recesses adapted to connect the attachment 5 to the container by, for instance, form-fit engagement.

By shortening the stretching means 3, a force can be applied between the two attachment points to lash a container or a stack of containers. Likewise the stretching means 3 can be lengthened to release such lashing, for instance, when unloading containers.

Further the lashing device 1 according to FIG. 1*a* has a coupling part 101 for rotation-preventing engagement with an end portion 19 of the stretching rod 9. The coupling part 101 counteracts, at least in one direction, that the stretching rod 9 is rotated relative to the nut part 11 due to vibrations, load changes, seaway or the like which affect the lashing system in operation. Consequently the coupling part 101 intends to prevent stretching rods in a lashing system from being unintentionally unscrewed in operation.

The coupling part 101 shown in FIG. 1*a* comprises a casing 103 which is movably arranged in the longitudinal direction of the stretching means 3. The movability is provided by the casing 103 sliding or running along the substantially parallel rods 15, 17 of the stretching means 3. For this purpose recesses 105 for form-fit engagement with the respective rods 15, 17 are arranged at the ends of the casing 103. The recesses 105 can have the shape of part of a circle with a geometry which substantially corresponds to the shape of the rods 15, 17. The shape of the recesses 105 matching that of the rods 15, 17 also results in the casing 103 being prevented from rotating relative to the rods 15, 17 of the stretching means 3. The casing 103 of the coupling part 101 can be formed in one piece or made of several parts which are joined to form the casing 103. Conveniently the casing 103 is made by forging or casting of metal, but it will be appreciated that also other methods and materials can be used.

Figure 1B:
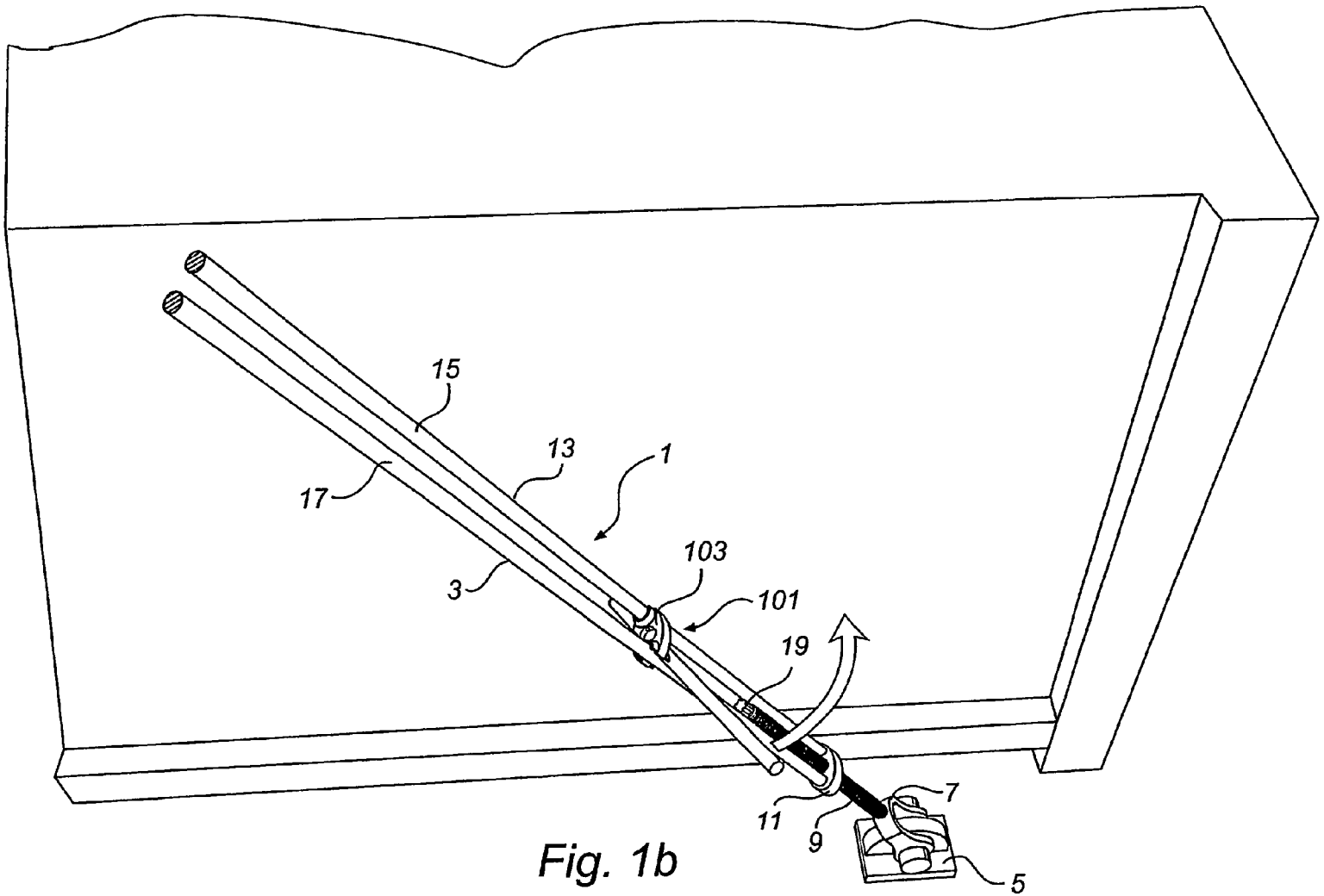
FIG. 1*b* is a schematic perspective view of part of a lashing device, comprising a coupling part in its inactive position.

FIG. 1*b* shows a lashing device 1 according to FIG. 1*a* where the casing 103 of the coupling part 101 has been disengaged from the stretching rod 9 by displacement in the longitudinal direction of the stretching means 3 along the two substantially parallel rods 15, 17. In this position it is possible to release, for instance by a tool, the lashing device 1 by mutual rotation of the two stretching means parts 7, 13 without the coupling part 101 counteracting the rotary motion.

Figure 2A:
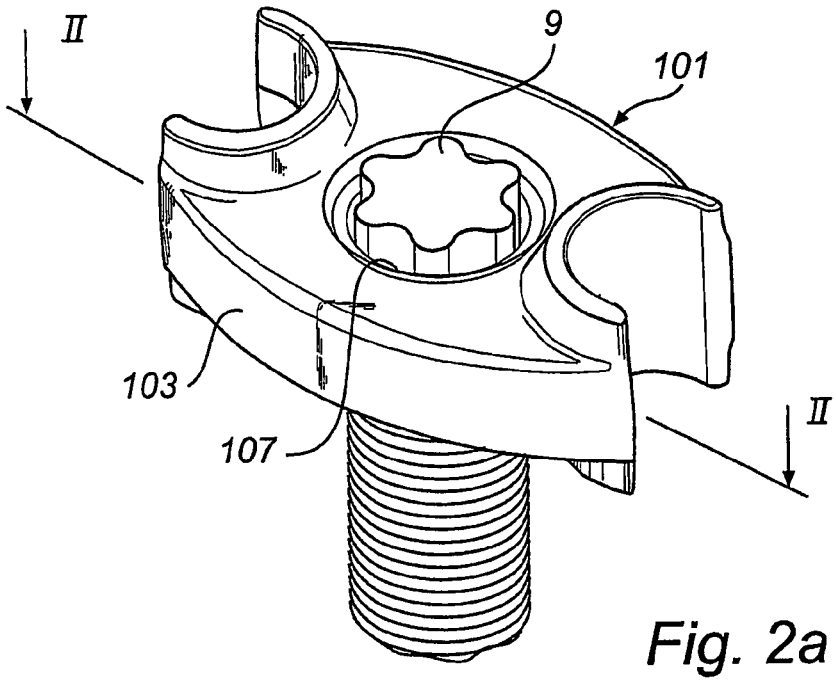
FIG. 2*a* is a schematic perspective view of a coupling part of a lashing device.

FIG. 2*a* is a schematic perspective view of an embodiment of a coupling part 101 which has a casing 103 arranged at one end of a stretching rod 9 of a lashing device 1. The casing 103 is formed with an opening 107 for insertion of the stretching rod 9. The edges of the opening 107 can be bevelled or rounded to facilitate guiding of the stretching rod 9 into the coupling part 101. The end portion 19 of the stretching rod 9 which is adapted to be inserted into the opening 107 of the coupling part 101 has an outer contour deviating from the circular shape. The outer contour is formed with grooves or recesses 109 which extend in the longitudinal direction of the stretching rod 9 and constitute a gripping part of the coupling part 101.

Figure 2B:
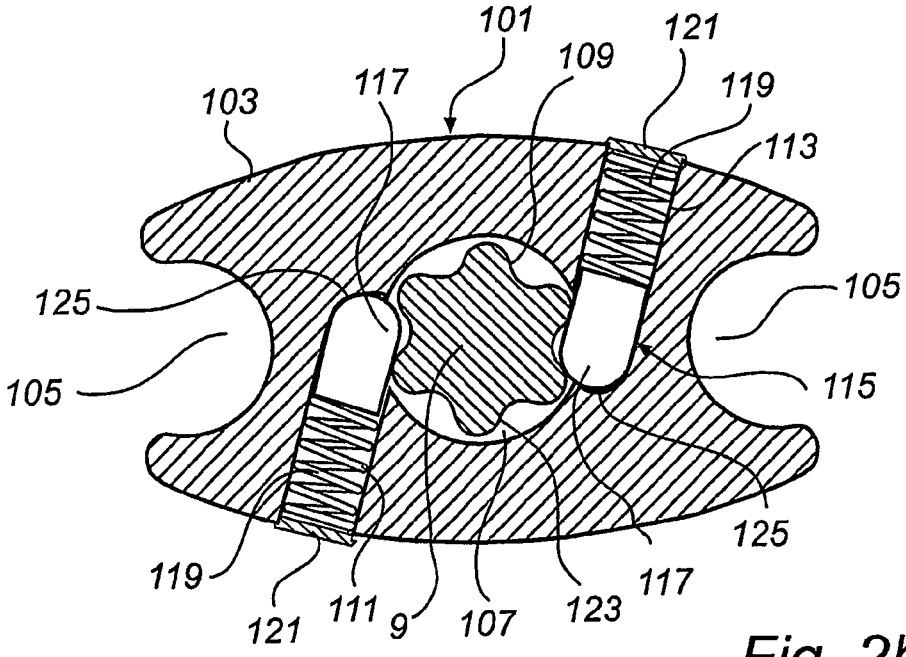
FIG. 2*b* is a cross-sectional view of the coupling part according to FIG. 2*a* taken along line II-II.

FIG. 2*b* is a sectional view taken along line II-II in FIG. 2*a*. In this embodiment, the coupling part 101 has a casing 103 with two bores 111, 113 extending through the casing 103, from the outside of the casing 103, and opening into the inner periphery of the opening 107 of the casing 103. An engaging portion 117 of an engaging part 115 is in the form of a pin-like element movably arranged in each bore 111, 113. Connected to each pin 117 there is a spring element 119, such as a helical spring, arranged in each bore 111, 113 between the engaging portion 117 and the mouth of the bore at the outer boundary surface of the casing. The spring element 119 is kept in the bore 111, 113 by a form fit washer 121 which is arranged at the bore end directed away from the stretching rod 9 and which constitutes an abutment. The pin 117 is by the spring load partially projectable from the mouth of the bore 111, 113 next to the stretching rod 9 to be moved into engagement with a gripping part 123 of the coupling part 101.

In the embodiment shown in FIG. 2*b*, the gripping part 123 of the coupling part 101 consists of the grooves or recesses 109 which are arranged in a portion of the circumferential surface of the stretching rod 9 and jointly form an undulated surface along the periphery of the stretching rod 9. For the embodiment shown in FIG. 2*b*, the grooves or recesses 109 are arranged in connection with the end portion 19 of the stretching rod 9, as shown in FIGS. 1 and 2. However, it will be appreciated that these grooves or recesses 109 can be arranged along other portions of the stretching rod 9 and be formed with a plurality of alternative geometries.

The pins 117 in the coupling part 101 are arranged to move, under spring load, along a path of travel which consists of the bores 111, 113. The extension of the two paths of travel or bores 111, 113 is arranged spaced from the centre of the stretching rod 9. When the pins 117 owing to the spring load partially project through the mouth of the bore 111, 113, the material of the casing 103 in connection with the mouths of the bores 111, 113 constitutes an end position abutment 125 for the movement of the pins 117, thus counteracting that the entire pin 117 can pass out through the mouth of the bore 111, 113.

The bores 111, 113 are arranged in relation to the gripping part 123 so that the pin 117 is forced into the bore 111, 113, that is away from the gripping part 123, in relative rotation between the stretching rod 9 and the nut part 11 of the second stretching means part in a direction of rotation which corresponds to the tightening (stretching) of the stretching means 3. Tightening or stretching of the stretching means 3 is provided by reducing the distance between the ends of the stretching means 3. By the pins 117, when abutting against the gripping part 123 of the coupling part 101, being allowed to be inserted into the bore 111, 113, a spring-loaded snap action is ensured.

On the other hand, in relative rotation between the stretching rod 9 and the nut part 11 of the second stretching means part in a direction of rotation which corresponds to release of the stretching means 3, the pins 117 are forced against the end position abutment 125 formed by the casing 103. Consequently, the rotation is counteracted by the pins 117 being moved into locking engagement with the gripping part 123 of the coupling part 101 which is arranged on the stretching rod 9. In this manner, the pins 117 are clamped between the end position abutment 125 and an abutment formed by the gripping part 123, whereby the coupling part 101 locks against rotation of the stretching rod 9 relative to the nut part 11 as shown in FIGS. 1 and 2. Thus the coupling part 101 provides a lashing function which counteracts that the lashing device 1 is unintentionally released due to vibrations, load changes, seaway or the like, for instance, during transport.

With a coupling part 101 according to FIGS. 2*a* and 2*b* it is possible to move the casing 103 of the coupling part 101 over the end portion 19 of the stretching rod 9 before accomplishment of the tightening of the lashing system 1. After the casing 103 of the coupling part 101 has been moved over the end portion 19 of the stretching rod 9 it is possible by the snap function to stretch or tighten the lashing device 1 by mutual rotation of the stretching means parts 7, 13. Having tightened the lashing device 1, the rotation-locking action counteracts that the stretching rod 9 is released owing to stress exerted on the lashing system 1. However it will be appreciated that it is also possible to move the casing 103 of the coupling part 101 over the end portion 19 of the stretching rod 9 after tightening the lashing system 1 to establish the rotation-locking action. When releasing the lashing device 1, the casing 103 of the coupling part 101 is removed by being moved away from the end portion 19 of the stretching rod 9, the stretching means parts 7, 13 being allowed to rotate relative to one another in the releasing direction of rotation.

Figure 3:
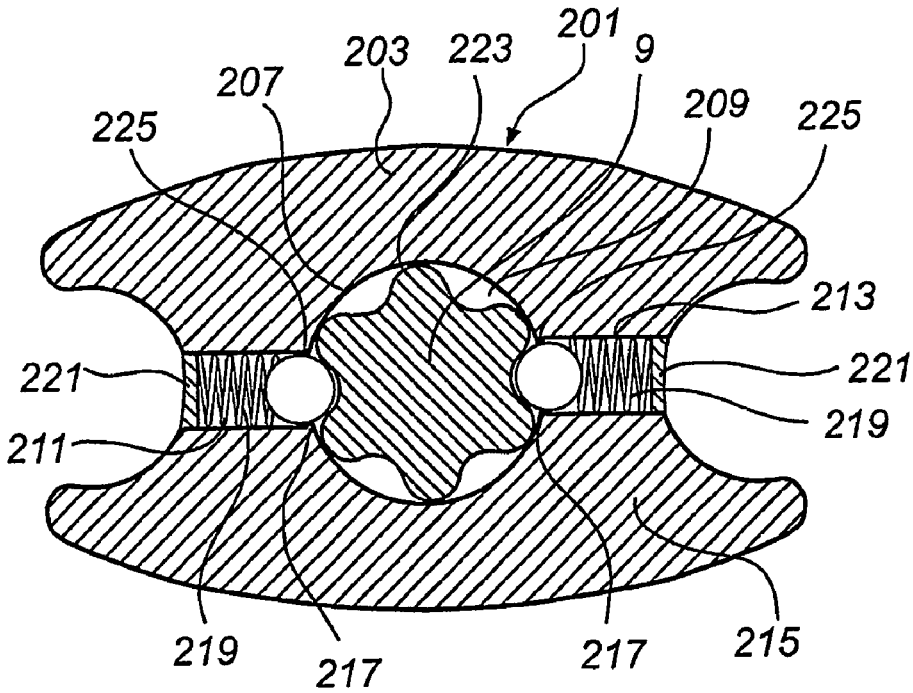
FIG. 3 is a cross-sectional view, corresponding to the section in FIG. 2, of an alternative embodiment of a coupling part.

FIG. 3 is a schematic view of an alternative embodiment of a coupling part 201 along a cross-section corresponding to the cross-section shown in FIG. 2*b*. The casing 203 of the coupling part 201 in FIG. 3 is arranged with through bores 211, 213 which extend radially relative to the stretching rod 9. An engaging portion 217 of the engaging part 215 consists of balls which are movably arranged in the respective bores 211, 213. Like the pins in the embodiment according to FIGS. 2*a* and 2*b*, the balls 217 are spring loaded by a spring element 219 which is located in the respective bores 211, 213 and kept in place by an abutment 221 arranged at one end of the bore.

The balls 217 are by spring load partially projectable from the mouth of the respective bores 211, 213 which is positioned next to the stretching rod 9 to be moved into engagement with a gripping part 223 of the coupling part 201. Moreover each bore 211, 213 is arranged with an end position abutment 225 which counteracts that the entire ball 217 can pass out through the mouth of the bore 211, 213 next to the stretching rod 9. The end position abutment 225 can be arranged by the end of the bore 211, 213 next to the stretching rod 1 being provided with a conical portion which forms a circular opening having a diameter slightly smaller than the diameter of the ball. It is also possible to provide the end position abutment 225 by deforming the edge of the mouth of the bore 211, 213 or arranging a separate element with an opening which is less than the diameter of the ball in connection with the mouth of the bore 211, 213. It will be appreciated that also in this embodiment it is possible to arrange the engaging portion 217 of the engaging part 215 as pins, like in the embodiment according to FIGS. 2*a* and 2*b*.

In the embodiment according to FIG. 3, the coupling part 201 provides by snap action rotatability of the lashing device in both the tightening and the releasing direction of rotation of the mutual rotation of the stretching means parts 7, 13. By the path of travel of the balls 217 in the respective bores 211, 213 extending radially relative to the stretching rod 9, it is made possible for the balls 217 to be forced into the bore 211, 213 both in the tightening and in the releasing direction of rotation. This is achieved by the gripping part 223 arranged on the end portion 19 of the stretching rod 9 having a shape which, in mutual rotation of the stretching means part 7, 13, presses the balls into the bore 211, 213 by abutment between the balls 217 and the gripping part 223.

For lashing, the casing 203 can be moved by the coupling part 201 over the end portion 19 of the stretching rod 9 before the stretching means 3 is tightened or stretched. Having arranged the casing 203 on the end portion 19 of the stretching rod 9, it is possible, by the snap function, to stretch the lashing device 1 by mutual rotation of the stretching means parts 7, 13 in the tightening direction of rotation. Having stretched the lashing device 1, the spring force between the engaging portion 217 of the engaging part 215 and the gripping part 223 counteracts that the lashing device 1 is unintentionally released due to vibrations, load changes, seaway or the like. Moreover, the snap function in both directions of rotation makes it possible to release the lashing device 1 without removing the casing 203 of the coupling part 201 from the end portion 19 of the stretching means 9.

Also in this embodiment it will be appreciated that it is possible to move the casing 203 of the coupling part 201 over the end portion 19 of the stretching means 9 after tightening of the lashing device 1. It will also be appreciated that it is possible to remove the casing 203 of the coupling part 201 from engagement with the end portion 19 of the stretching rod 9 before releasing the lashing system 1.

Figure 4:
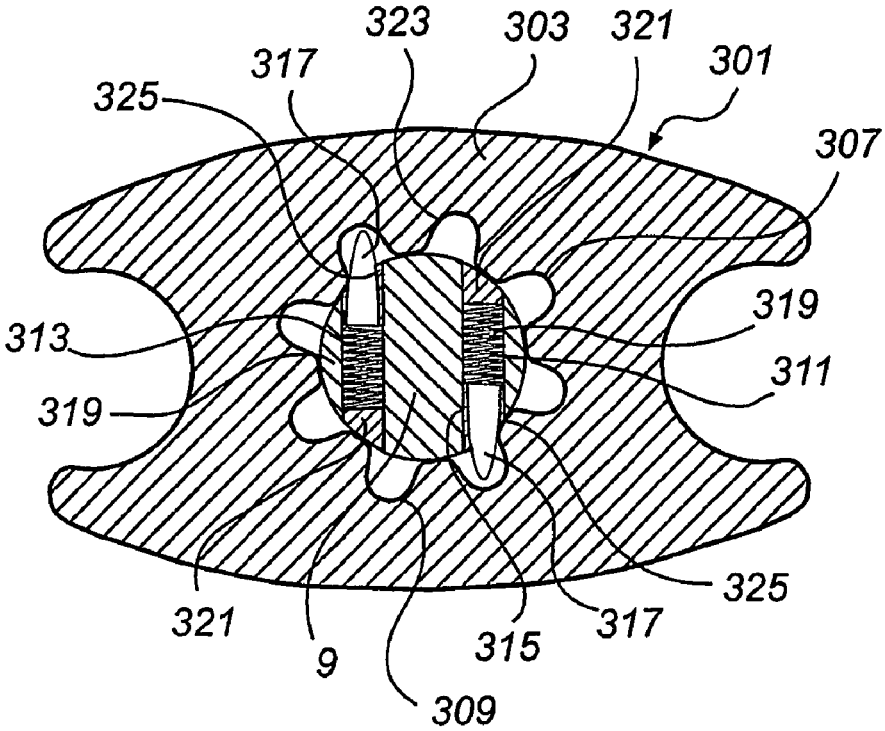
FIG. 4 is a cross-sectional view, corresponding to the section in FIG. 2, of an alternative embodiment of a coupling part.

FIG. 4 is a further schematic view of an alternative embodiment of a coupling part 301 for lashing systems, also here along a cross-section corresponding to the cross-section shown in FIG. 2*b*. In this embodiment, the stretching rod 9 is provided with an engaging portion 317 of an engaging part 315 and the casing 303 of the coupling part 301 is provided with a gripping part 323.

An opening 307 arranged in the casing 303 of the coupling part 301, which opening is adapted to receive the end portion 19 of the stretching rod 9, is at its cylindrical circumferential surface formed with grooves or recesses 309 which extend through the casing 303. Consequently the gripping part 323 of the coupling part 301 forms an undulated surface extending along the edge of the opening 307, which surface corresponds to the surface arranged on the stretching rod 9 in the embodiments illustrated in FIGS. 2*a*-2*b* and 3.

The stretching rod 9 is provided with two bores 311, 313 which extend through the stretching rod 9. Each bore 311, 313 is arranged at a distance from and at each side of the centre of the stretching rod 9. A pin-like engaging portion 317 of an engaging part 315 is arranged in each bore 311, 313. A spring element 319 is connected to each pin 317 and arranged to be kept in the bore 311, 313 by means of an abutment 321 which is arranged at one end of the bore and which can be formed like the abutments in the embodiments illustrated in FIGS. 2*a*-3.

In the same way as in the embodiments according to FIGS. 2*a*-3, the pins 317 are by spring load partially projectable from the mouth of the respective bores 311, 313 to be moved into engagement with the gripping part 323 of the casing 303 of the coupling part 301. The pins 317 are arranged opposite to each other in the bores 311, 313. An end position abutment 325 is arranged in each bore 311, 313 to counteract that the entire pin 317 can pass out through the mouth. The end position abutment 325 can be arranged similarly to the embodiment in FIG. 3.

Similarly to the embodiment in FIGS. 2*a*-2*b*, each pin 317 is forced into the bore 311, 313, that is away from the gripping part 323, in relative rotation between the stretching rod 9 and the nut part 11 of the second stretching means part 13 in a direction of rotation which corresponds to tightening (stretching) of the stretching means 3. This means that also in this embodiment a spring-loaded snap action is made possible to allow the stretching rod 9 to rotate relative to the engaging portion 317 of the engaging part 315 in mutual rotation of the stretching means parts 7, 13 in a tightening or stretching direction of rotation.

In relative rotation between the stretching rod 9 and the nut part 11 of the second stretching means part 13 in a direction of rotation corresponding to release (lengthening) of the stretching means 3, the pins 317 are forced against the end position abutment 325 arranged at the end portion of each bore 311, 313. Consequently the rotation is counteracted by the pins 317 being clamped between the end position abutment 325 and an abutment formed by the gripping part 323, the coupling part 301 locking the stretching rod 9 against rotation relative to the nut part 11 similarly to the embodiment in FIG. 2. Thus the coupling part 301 provides, in this embodiment, a lashing function which counteracts that the lashing device 1 is unintentionally released due to vibrations, load changes, seaway or the like during transport for instance.

The technique of tightening and releasing a lashing device 1 by means of a coupling part 301 in FIG. 4 can be compared with the technique that has been described for the embodiment in FIGS. 2*a* and 2*b*.

Figure 5:
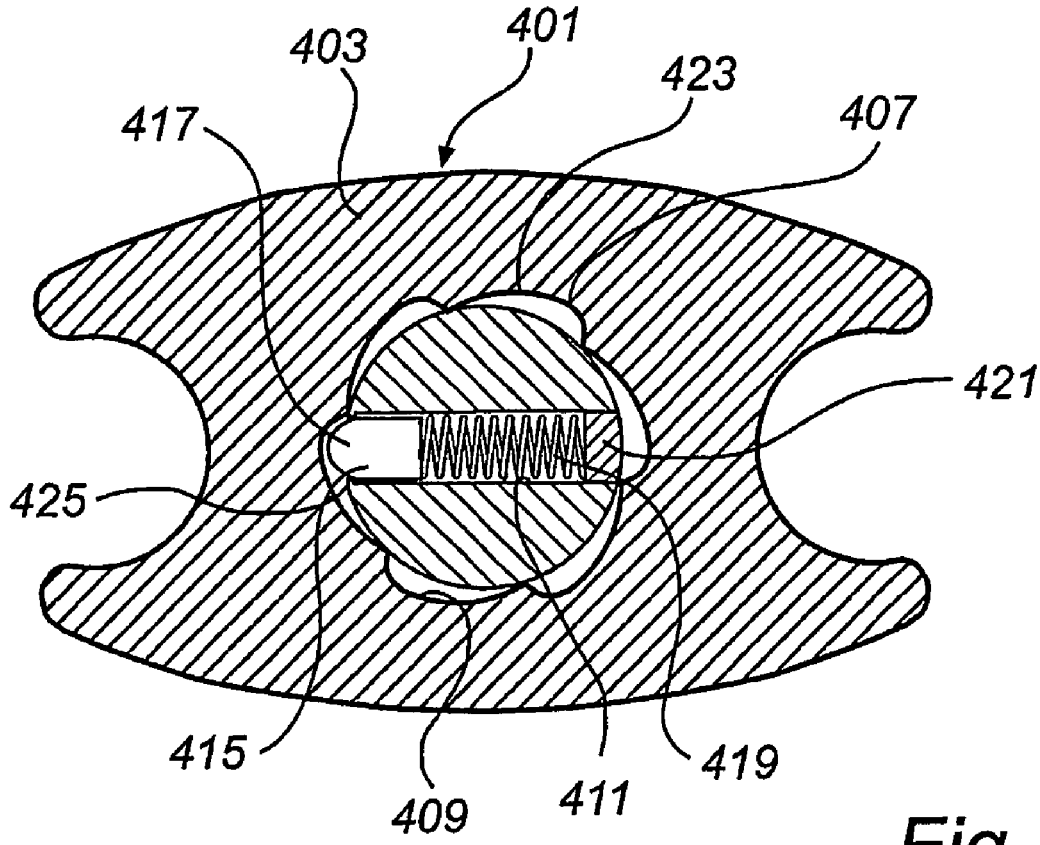
FIG. 5 is a cross-sectional view, corresponding to the section in FIG. 2, of an alternative embodiment of a coupling part.

FIG. 5 is a schematic view of another embodiment of a coupling part 401 of a lashing device 1, also in this case along a cross-section corresponding to the cross-section shown in FIG. 2*b*. In this embodiment, the stretching rod 9 is provided with an engaging portion 417 of an engaging part 415 and the casing 403 of the coupling part 401 is provided with a gripping part 423.

An opening 407 in the casing 403 of the coupling part 401 which is adapted to receive the end portion 19 of the stretching rod 9 is at its cylindrical circumferential surface provided with projecting portions which are bevelled or inclined in a direction to form a soft transition to the casing 403. The projecting portions form at their other side an edge that is sharper, or steeper, relative to the sloping part. This projecting portion constitutes the gripping part 423 of the coupling part 401.

Furthermore the stretching rod 9 is arranged with a through bore 411 which extends radially through the centre of the stretching rod 9. At one end of the bore 411 a pin 417 is arranged and at the other end an abutment 421 for a spring 419 is arranged.

The pin 417 is, by spring load, partially projectable from the mouth of the bore 411 to be moved into engagement with the gripping part 423 of the casing 403 of the coupling part 401. An end position abutment 425 is arranged in the bore 411 to counteract that the entire pin 417 can pass out through the mouth. The end position abutment 425 can be arranged similarly to the embodiments in FIGS. 3 and 4.

In the embodiment shown in FIG. 5, the bevelled or sloping edge of the projecting portion constitutes a soft abutment between the gripping part 423 and the pin 417 in relative rotation between the stretching rod 9 and the nut part 11 of the second stretching means part 13 in a direction of rotation corresponding to tightening (stretching) of the stretching means 3. Consequently a spring-loaded snap action is provided where the pin 417 is forced into the bore 411 as it rides on the bevelled edge of the projecting portion.

On the other hand, in relative rotation between the stretching rod 9 and the nut part 11 of the second stretching means part 13 in a direction of rotation corresponding to release of the stretching means 3, the pin 417 is forced against the steeper edge of the projecting portion. Consequently the rotation is counteracted by the pin 417 being moved into locking or squeezing engagement with the projecting portion of the casing 403 of the coupling part 401. In this way, the coupling part 401 locks the stretching rod 9 against rotation relative to the nut part 11.

The technique of tightening and releasing a lashing device 1 by a coupling part 401 according to FIG. 5 can be compared with the technique that has been described for the embodiments in FIGS. 2*a*-2*b* and 4.

Figure 6:
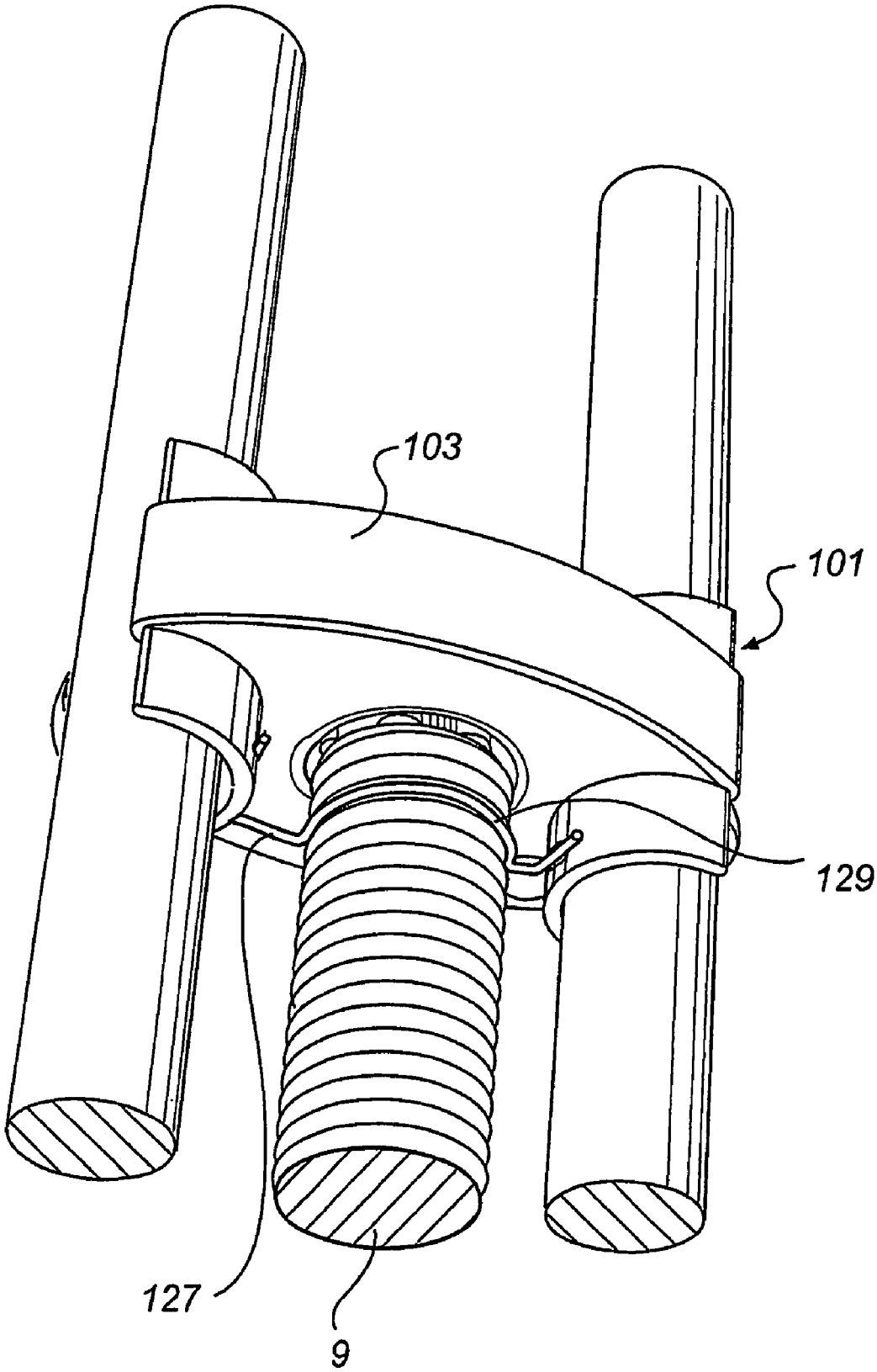
FIG. 6 is a schematic perspective view of part of a lashing device, comprising a coupling part with a locking element.

FIG. 6 shows an alternative embodiment of a coupling part 101. The coupling part 101 shown in FIG. 6 is arranged with a locking element 127 to axially lock the casing 103 of the coupling part 101 relative to the longitudinal direction of the stretching rod 9 when the casing 103 of the coupling part 101 is moved over the end portion 19 of the stretching rod 9. The locking element 127 is preferably formed as a resilient yoke which can be moved into engagement with the threaded portion which is positioned in connection with the end portion 19 of the stretching rod 9. The curved yoke 127 has a substantially part-circular portion 129 which can partly enclose and engage the threaded portion of the stretching rod 9. Such axial locking of the casing 103 of the coupling part 101 is particularly preferred for horizontal lashing where a low, or no, dead weight acts on the coupling part 101 to keep it at the end of the stretching rod 9. The locking element 127 shown in FIG. 6 is connected with the casing 103 of the coupling part 101 at the side which is intended to be oriented towards the end of the stretching rod 9 and is preferably located inside an outer boundary surface of the casing 103 to be protected from, for instance, shocks and impacts.

Figure 7:
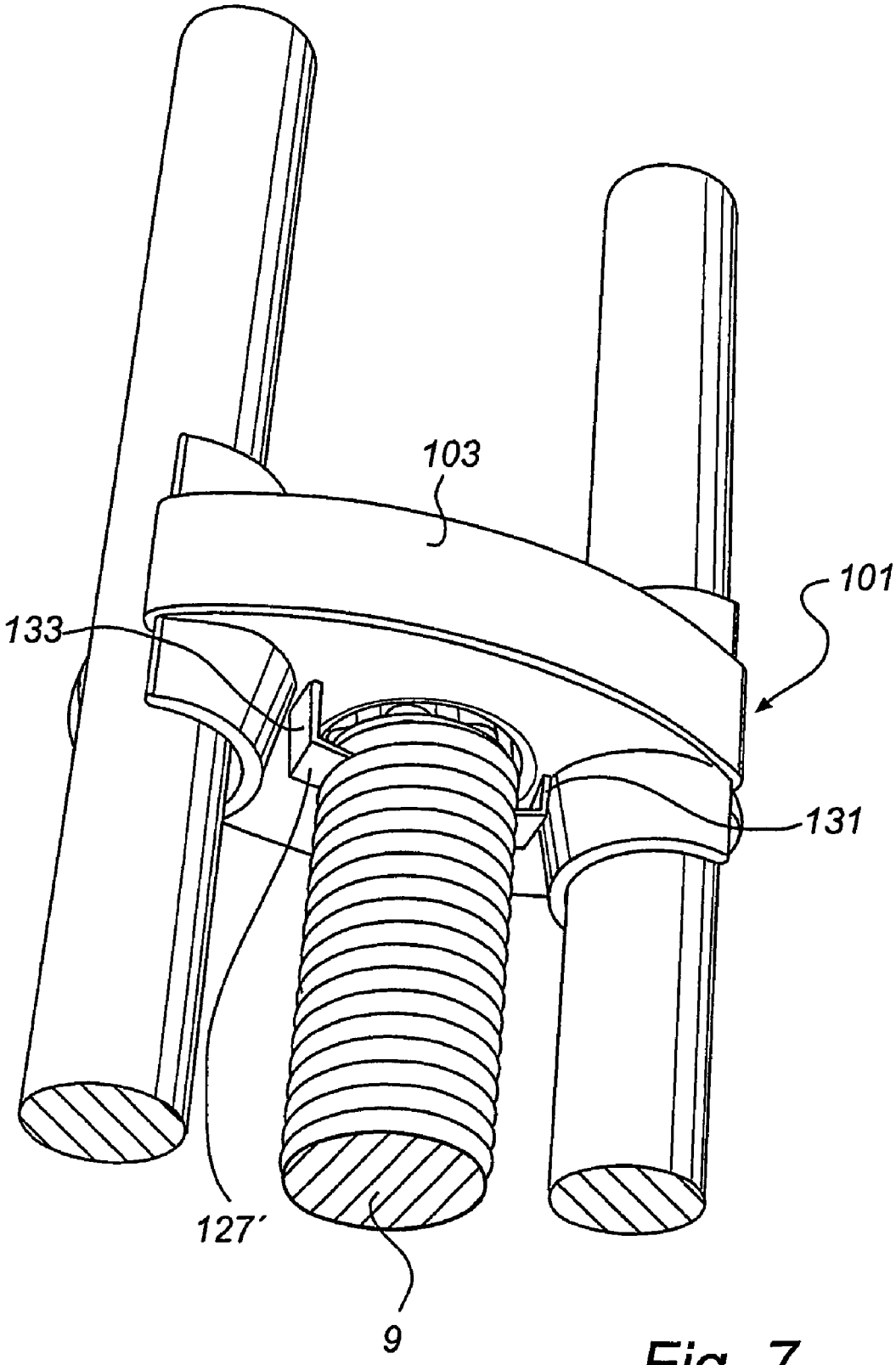
FIG. 7 is a schematic perspective view of part of a lashing device, comprising an alternative embodiment of a coupling part with a locking element.

FIG. 7 illustrates an alternative embodiment of a locking element 127' to keep the casing 103 of the coupling part 101 in the axial direction of the extent of the stretching rod 9. The locking element 127' shown in FIG. 7 is formed with two hooks 131, 133 which project from the casing 103 and are angled towards the threaded portion 9 of the stretching rod. When the coupling part 101 is moved over the end portion 19 of the stretching rod 9, each hook 131, 133 engages the threaded portion of the stretching rod 9 close to the end thereof. Preferably the hooks 131, 133 are made of a resilient material.

It will be appreciated that the locking elements 127; 127' of the type described above can be arranged in all above-described embodiments of the coupling part 101; 201; 301; 401.

A number of embodiments of a lashing device have been presented above, but it must be considered obvious to a person skilled in the art that they can be combined in various ways.

The invention claimed is:

1. A lashing device, comprising:

a stretching device, to be fastened between two fixing points to be secured to one another, the stretching device including stretching device parts, each connectible to one of the fixing points, at least a first stretching device part including a stretching rod extending in a longitudinal direction of the stretching device and including a threaded portion, a second stretching device part supporting a nut part to be screwed onto a thread of the first stretching device part; and a coupling part, arranged between said first and said second stretching device parts, to, by snap action, allow mutual rotation of the two stretching device parts in at least a direction of rotation which corresponds to tightening of the stretching device and to counteract rotation in the opposite direction.

2. A lashing device as claimed in claim 1, wherein said coupling part includes an engaging part to, by said snap action, cooperate with a gripping part, the engaging part and the gripping part being each separately connected with either the first or the second stretching device part.

3. A lashing device as claimed in claim 2, wherein the engaging part is arranged to be movable in a direction away from said gripping part during mutual rotation of the two stretching device parts in at least the direction of rotation that corresponds to tightening of the stretching device.

4. A lashing device as claimed in claim 2, wherein said engaging part is arranged as a locking device to, by lock action, lock against mutual rotation of the stretching device parts in the direction opposite to tightening of the stretching device.

5. A lashing device as claimed in claim 2, wherein an engaging portion of said engaging part is arranged to be clamped between an abutment of said gripping part and an abutment of the engaging part during mutual rotation between the stretching device parts in the direction opposite to tightening of the stretching device.

6. A lashing device as claimed in claim 5, wherein the gripping part is arranged to move the engaging portion of said engaging part away from said abutment of the engaging part during mutual rotation between the stretching device parts in said direction of tightening the stretching device.

7. A lashing device as claimed in claim 2, wherein an engaging portion of said engaging part is spring loaded towards the gripping part.

8. A lashing device as claimed in claim 2, wherein an engaging portion of said engaging part is, under spring load, at least partially projectable from a peripheral surface of an opening in the coupling part into engagement with the gripping part.

9. A lashing device as claimed in claim 2, wherein an engaging portion of the engaging part is movable along a path of travel which extends in a direction spaced from the center of said stretching rod.

10. A lashing device as claimed in claim 2, wherein an engaging portion of said engaging part is arranged in at least one bore which extends in said coupling part.

11. A lashing device as claimed in claim 10, wherein an end portion, positioned next to the gripping part, of said bore is designed to form an end position abutment for the engaging portion of the engaging part.

12. A lashing device as claimed in claim 1, wherein said coupling part extends between the first and the second stretching device part during said snap action.

13. A lashing device as claimed in claim 1, wherein said coupling part is movable relative to said stretching rod in the longitudinal direction of the stretching device.

14. A lashing device as claimed in claim 1, wherein said coupling part is movable relative to said nut part in the longitudinal direction of the stretching device.

15. A lashing device as claimed in claim 1, wherein said coupling part is arranged to be movable between an active position and an inactive position, the coupling part in the active position being moved over a portion of said stretching rod for locking against mutual rotation of the stretching device parts in the direction opposite to tightening of the stretching device, while mutual rotation of the stretching device parts in the direction opposite to tightening of the stretching device is allowed when the coupling part is removed from said portion in the inactive position of the coupling part.

16. A lashing device as claimed in claim 15, wherein said portion of the stretching rod constitutes an end portion, positioned next to the coupling part, of the stretching rod.

17. A lashing device as claimed in claim 1, wherein said coupling part is provided with a locking element for locking engagement with said stretching rod and counteraction of movement of the coupling part in the longitudinal direction of the stretching device when connecting said stretching device parts to each other.

18. A lashing device as claimed in claim 17, wherein said locking element is made of a resilient material.

19. A lashing device as claimed in claim 17, wherein said locking element is designed to be moved into engagement with a threaded portion of said stretching rod.

20. A lashing device as claimed in claim 17, wherein said locking element is arranged as a yoke with a substantially part-circular portion to at least partly enclose and engage said stretching rod.

* * * * *